US005807665A

United States Patent [19]

Saitou

[11] Patent Number: 5,807,665

[45] Date of Patent: Sep. 15, 1998

[54] SILVER HALIDE EMULSION

[75] Inventor: Mitsuo Saitou, Minami-Ashigara, Japan

[73] Assignee: Fuji Photo Film Co., Ltd., Kanagawa, Japan

[21] Appl. No.: 630,335

[22] Filed: Apr. 10, 1996

[30] Foreign Application Priority Data

Apr. 14, 1995 [JP] Japan ..... 7-089124

[51] Int. Cl.[6] ..... G03C 1/053; G03C 1/04; G03C 1/035; G03C 1/015

[52] U.S. Cl. ..... 430/569; 430/567; 430/637

[58] Field of Search ..... 430/569, 637

[56] References Cited

U.S. PATENT DOCUMENTS

| | | | |
|---|---|---|---|
| 3,113,026 | 12/1963 | Sprung | 430/599 |
| 5,264,337 | 11/1993 | Maskasky | 430/567 |
| 5,292,632 | 3/1994 | Maskasky | 430/567 |
| 5,405,738 | 4/1995 | Uchida | 430/567 |
| 5,665,530 | 9/1997 | Oyamada et al. | 430/567 |
| 5,707,793 | 1/1998 | Oyamada | 430/567 |
| 5,726,006 | 3/1998 | Gourlaouen et al. | 430/567 |

FOREIGN PATENT DOCUMENTS

| | | | |
|---|---|---|---|
| 0 534 395 A1 | 3/1993 | European Pat. Off. | G03C 1/005 |
| 0576880 | 1/1994 | European Pat. Off. | G03C 1/035 |
| 0645670 | 3/1995 | European Pat. Off. | G03C 1/035 |

*Primary Examiner*—Mark F. Huff
*Attorney, Agent, or Firm*—Sughrue, Mion, Zinn, Macpeak & Seas, PLLC

[57] ABSTRACT

A silver halide emulsion is disclosed, comprising at least a dispersing medium and silver halide grains, wherein at least 60% of the total projected area of silver halide grains is occupied by tabular grains having a crystal defect for anisotropic growth which have a {100} face as a main plane and an aspect ratio (diameter/thickness ratio) of not less than 2.0, and the right-angled parallelogram enclosed with {100} faces at the edges of the tabular grains or a right-angled parallelogram formed by extending the {100} faces at the edges having a slenderness side ratio (a ratio of the length of the long side to that of the short side) of 1 to 6; and said silver halide emulsion is prepared in the presence of a compound $A^0$ and/or a compound $B^0$, wherein the compound $A^0$ represents an organic compound having covalently bonded to an individual molecule thereof at least two molecules of an adsorbable agent which accelerates formation of a {100} face of silver bromide grains, and the compound $B^0$ represents an organic compound except gelatin having at least four alcoholic groups per molecule, both the compounds $A^0$ and $B^0$ are organic compounds except gelatin and other proteins. The emulsion is excellent in sensitivity, image quality and preservability.

11 Claims, 1 Drawing Sheet

SILVER HALIDE EMULSION

FIELD OF THE INVENTION

The present invention relates to a silver halide emulsion useful in the field of photography. More particularly, it relates to a silver halide emulsion particularly excellent in sensitivity, image quality, and preservability.

BACKGROUND OF THE INVENTION

As compared with non-tabular silver halide (here-inafter, a silver halide is referred to as AgX) grains, use of tabular AgX grains into light-sensitive materials reduces the ratio of incident light's passing through the light-sensitive layer without being utilized thereby to increase light absorption efficiency and also brings about improvements in image quality in terms of covering power, sharpness and graininess, development progress, spectral sensitization characteristics, and the like. Tabular grains having twinning planes parallel to each other and {111} faces as a main plane have therefore been made frequent use of. While a {111} plane is generally made up mostly of halide ions (hereinafter referred as $X^-$), a {100} face is made up of $Ag^+$ and $X^-$ alternating each other and provides superior photographic properties. Therefore, interest has recently been turned to tabular grains whose main plane is a {100} face (hereinafter simply referred to as {100} tabular grains). For the details of conventional {100} tabular grains, reference can be made to JP-A-51-88017 (the term "JP-A" as used herein means an "unexamined published Japanese patent application"), JP-B-64-8323 (the term "JP-B" as used herein means an "examined published Japanese patent publication"), JP-A-5-281640, JP-A-5-313273, JP-A-6-59360, JP-A-6-324446, EP 0534395A1, and U.S. Pat. Nos. 5,292,632, 5,314,798, and 5,264,337. The present invention is to provide an improved {100} tabular grain emulsion as compared with the conventional {100} tabular grain emulsions. While {100} tabular grains owe their tabular form to crystal defects enabling preferential growth in the edge direction, the shape characteristics and photographic characteristics of tabular grains largely vary depending on the method of crystal defect formation. These characteristics also largely vary depending on the method of grain growth. Hence, improvements on methods of defect formation and grain growth have been attracting attention.

EP 0534395A1 supra has a mention of formation of tabular grains in the presence of an adsorbable agent which accelerates formation of a {100} face. However, the technique disclosed yields unsatisfactory results in terms of grain shape and photographic properties.

SUMMARY OF THE INVENTION

An object of the present invention is to provide a method for preparing an AgX emulsion excellent in sensitivity, image quality and preservability.

The object of the present invention has been accomplished by a method for preparing an AgX emulsion comprising at least a dispersing medium and AgX grains, wherein at least 60% of the total projected area of AgX grains is occupied by tabular grains having a crystal defect for anisotropic growth which have a {100} face as a main plane and an aspect ratio (diameter/thickness ratio) of not less than 2.0, and the right-angled parallelogram enclosed with {100} faces at the edges of the tabular grains or a right-angled parallelogram formed by extending the {100} faces at the edges having a slenderness side ratio (a ratio of the length of the long side to that of the short side) of 1 to 6; and the AgX emulsion is prepared in the presence of a compound $A^0$ and/or a compound $B^0$, wherein the compound $A^0$ represents an organic compound which is covalently bonded with at least two molecules of an adsorbable agent which accelerates formation of a {100} face of an AgBr grain, and the compound $B^0$ represents an organic compound except gelatin having at least two alcoholic groups per molecule, both the compounds $A^0$ and $B^0$ are organic compounds except gelatin and other proteins.

21—Surface of AgX grain

22—Main chain of adsorbable agent $A^0$

Figure 1:
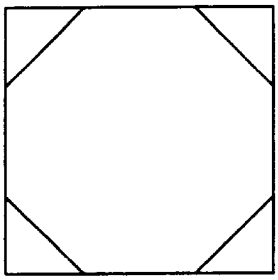
FIG. 1 is a top view of a tetradecahedral AgBr grain.

23—Residual group of compound $C^0$ which is covalently bonded to adsorbable agent $A^0$

30—Portion corresponding to nucleus

31—Dislocation line

32, 33, 35—Step line of edge surface

34—Dislocation line transferred

DETAILED DESCRIPTION OF THE INVENTION

Compound $A^0$ is represented by formula (I), and compound is represented by formula (II) shown below, in which small letters a, b, d, and e each represent a weight percentage, a+b=100 and d+e=100.

$$—(A)_a—(B)_b— \quad (I)$$

$$—(D)_d—(E)_e— \quad (II)$$

[I] Compound $A^0$:

Compound $A^0$ is an organic compound which is covalently bonded with at least 2, preferably 4 to 1000, still preferably 8 to 100, particularly preferably 20 to 100, molecules of an adsorbable agent $C^0$ which accelerates formation of {100} faces of AgBr grains per molecule thereof. Adsorbable agent $C^0$ is a compound possessing the following characteristics. Firstly, normal AgBr emulsion grains having an average diameter of about 0.2 μm are formed in the presence of conventional photographic gelatin. From the resulting emulsion are sampled $N^0$ emulsions of equal amount as seed crystals. One of the sample emulsions is put into an aqueous solution of a conventional gelatin dispersing medium, and $Ag^+$ and $Br^-$ are added thereto at 60° C. while maintaining the silver potential constant according to a double jet process thereby to allow the seed crystals to grow to an average diameter of about 1.0 μm without inducing formation of new nuclei. The experiment was repeated at various silver potentials to obtain the relationship of grain shape vs. silver potential. Another series of experiments are carried out in the same manner, except that compound $A^0$ having adsorbable agent $C^0$ covalently bonded as described above is added to the aqueous solution of gelatin in an amount of 30% by weight based on the gelatin, to similarly obtain the relationship of grain shape vs. silver potential. The amount of gelatin present in the aqueous solution at the start of grain growth is 18 g/l, and the amount of $Ag^+$ added is 70 g in terms of silver nitrate ($AgNO_3$). The pH of the grain growth system is a given value which is not lower than the pKa of compound $A^0$, preferably (pKa+0.5). "pKa" represents an acid dissociation constant. The silver potential as referred to above is a potential of a silver rod with reference to a saturated calomel electrode at room temperature. The silver potential can be measured by using an AgBr electrode, an AgI electrode, an $Ag_2S$ electrode or a mixed crystal electrode thereof in place of the silver rod. All the experiments should be carried out under the same conditions except for the presence or absence of compound $A^0$.

A comparison of the results of the two series of experiments reveals that the silver potential required for obtaining tetradecahedral grains in the former grain formation is lower than that required for obtaining grains of the same shape in the latter gelatin system (without compound $A^0$) by generally 10 mV or more, preferably 20 to 150 mV, still preferably 30 to 120 mV, particularly preferably 50 to 100 mV. In the case that the silver potential is shifted is such the low potential by making a certain compound present in a certain amount, the amount of potential shifted is called "an equilibrium crystal habit potential-shifted amount". The tetradecahedral grains are preferably those having a shape of a cube with its every corner broken off by 30% of each side length. The top view of such the tetradecahedral grain is shown in FIG. 1. For the particulars of silver potential measurement and others refer to Shin Munemori, et al. (trans.), *Ion Sentakusei Denkvoku*, Kyoritsu Shuppan (1977) and *Denki Kagaku Binran*, Ch. 5, Maruzen (1985).

Adsorbable agent $C^0$ is an organic compound having at least one nitrogen atom having a resonance stabilized π-electron pair. Examples of adsorbable agent $C^0$ includes (i) heterocyclic compounds having nitrogen in its ring, such as substituted or unsubstituted and saturated or unsaturated heterocyclic compounds having one nitrogen atom as a sole hetero atom (e.g., pyridine, indole, pyrrolidine, and quinoline) and substituted or unsubstituted and saturated or unsaturated heterocyclic compounds having one nitrogen atom and at least one additional hetero atom selected from nitrogen and oxygen (e.g., imidazoline, imidazole, pyrazole, oxazole, piperazine, triazole, tetrazole, oxadiazole, oxatriazole, dioxazole, pyrimidine, pyrimidazole, pyrazine, triazine, tetrazine, and benzimidazole); and (ii) organic compounds comprising an aromatic ring substituted with a nitrogen-containing group, represented by formula (III):

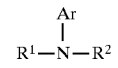

(III)

wherein Ar represents an aromatic ring having 5 to 14 carbon atoms, preferably an aromatic ring comprising a carbon ring; and $R^1$ and $R^2$ each represent a hydrogen atom, Ar, or an aliphatic group, or they are taken together to form a 5- or 6-membered ring, (e.g., aniline, α-naphthylamine, carbazole, 1,8-naphthyridine, nicotine, and benzoxazole). For the other particulars refer to EP 0534395A1 and JP-A-6-19029. Imidazole and benzimidazole are preferred of the organic compound groups (i) and (ii).

Compound $A^0$ can be prepared by polymerizing (including dimerizing) a polymerizable ethylenically unsaturated monomer represented by formula (IV):

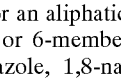

(IV)

wherein $C^1$ represents a residual group of compound $C^0$ bonded to the monomer; and $R^3$ represents a hydrogen atom or an alkyl group having 1 to 10 carbon atoms (preferably 1 to 5 carbon atoms), or copolymerizing the monomer of formula (IV) with a copolymerizable ethylenically unsaturated monomer represented by formula (V):

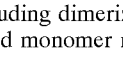

(V)

wherein $d^1$ represents a functional group; and $R^4$ has the same meaning as $R^3$.

The monomers of formula (IV) may be used either individually or as a mixture of two or more thereof. The copolymerization ratio of monomers is selected so as to meet the aforesaid condition. On being copolymerized, the compound of formula (V) provides repeating units B or E in the formulae (I) and (II).

Specific examples of the monomer of formula (IV) include those having a heterocyclic group containing a basic nitrogen atom, such as vinylimidazole, 2-methyl-1-vinylimidazole, 4-vinylpyridine, 2-vinylpyridine, N-vinylcarbazole, 4-acrylamidopyridine, N-acryloylimidazole, N-2-acryloyloxyethylimidazole, 4-N-(2-acryloyloxyethyl)-aminopyridine, 1-vinylbenzimidazole, N-vinylbenzylimidazole, N-methacroyloxyethylpyrrolidine, N-acryloylpiperazine, 1-vinyltriazole, 3,5-dimethyl-1-vinylpyrazole, N-methacroyl-oxyethylmorpholine, N-vinylbenzylpiperidine, and N-vinylbenzylmorpholine.

The copolymerizable ethylenically unsaturated monomers which can provide repeating unit B in formula (I) preferably include those providing a homopolymer soluble in any of acidic, neutral or alkaline aqueous solutions. Specific examples include nonionic monomers, such as acrylamide, methacrylamide, N-methylacrylamide, N,N-dimethylacrylamide, N-acryloylmorpholine, N-ethylacrylamide, diacetonacrylamide, N-vinylpyrrolidone, and N-vinylacetamide; monomers having an anionic group, such as acrylic acid, methacrylic acid, itaconic acid, vinylbenzoic acid, styrenesulfonic acid, styrenesulfinic acid, phosphonoxyethyl acrylate, phosphonoxyethyl methacrylate, 2-acrylamido-2-methylpropanesulfonic acid, and 3-acrylamidopropionic acid; salts of these monomers; and monomers having a cationic group, such as N,N,N-trimethyl-N-vinylbenzylammonium chloride and N,N,N-trimethyl-N-3-acrylamidopropylammonium chloride.

Unit B is a copolymer of one or more of these monomers. Unit B may contain other units derived from hydrophobic ethylenically unsaturated monomers in a proportion that would not lose water solubility of the molecule of formula (I) as a whole.

For example, examples of the ethylenically unsaturated monomers include a fatty acid mono-ethylenically unsaturated ester such as vinyl acetate and allyl acetate, an ethylenically unsaturated monocarboxylic acid or dicarboxylic acid ester such as methacrylic acid ester, an ethylenically unsaturated monocarboxylic acid amide such as t-butylacryl-amide, mono-ethylenically unsaturated compound such as acrylonitrile and methacrylonitrile, and diene compounds such as butadiene and isoprene. Other examples include ethene, propene, 1-butene, styrene, α-methylstyrene and methyl-vinyl-ketone.

In formula (I), a is generally 0.2 to 100, preferably 1 to 80, more preferably 5 to 70, most preferably 15 to 60.

The molecular weight of compound $A^0$ is generally 150 to $1\times10^6$, preferably 300 to $3\times10^5$ and more preferably $1\times10^3$ to $3\times10^5$.

In formula (IV), the $C^1$ group and ethylenically unsaturated monomer can be chemically bonded via a divalent linking group L, such as in $H_2C{=}C(H)—L—C^1$ as well as they are directly chemically bonded as shown in formula (V). For example, the examples of chemical bonding due to a divalent linking group L include $H_2C{=}C(H)—CONH—C^1$ and $H_2C{=}C(H)COO—C^1$. The divalent linking group L and a bonding system are described in detail in JP-A-3-109539 and JP-A-4-226449.

Compound $A^0$generally is a polymer in which generally 2 molecules or more (preferably 4 to $10^3$ molecules, more preferably 8 to $10^2$ molecules and most preferably 20 to $10^2$ molecules) of polymerizable monomers having a $C^1$ in formula (IV) are polymerized.

Compound $A^0$can be formed by polymerizing the polymerizable monomer having $C^1$, or by bonding $C^1$ to a polymer which is previously present.

Examples of polymerization method for obtaining compound $A^0$ include addition polymerization, condensation polymerization, polyaddition polymerization, ring-opening polymerization and addition condensation. Among these, addition polymerization of a vinyl compound, a vinylidene compound and a diene compound are preferred and particularly addition polymerization of vinyl compound is preferred.

These polymerization methods are described in detail in Nippon Kagakukai (ed.), *Shin-Jikken Kagaku Koza*, vol. 19, "High Molecule Chemistry", Maruzen, (1978); and *Fourth-Jikken Kagaku Koza*, vol. 28–29, Maruzen (1992).

The polymerizable monomer has one or more groups of the $C^1$ group in formula (IV), preferably 1 to 3 groups of $C^1$ and more preferably one group of $C^1$.

The $C^1$ (group) is bonded as a branched chain of the polymer without a main chain of the polymer. Compound $A^0$ is preferably a polymer of at least one ethylenically unsaturated monomer and has generally at least 2, preferably 4 to 1000, still preferably 8 to 100, particularly preferably 20 to 100 imidazole groups or benzimidazole groups per one molecule.

[II] Compound $B^0$:

Compound $B_0$ is an organic compound other than proteins and gelatin and preferably has a molecular weight of 90 or more, still preferably 300 to 1,000,000, particularly preferably 1000 to 100,000, most preferably 3000 to 100,000, and contains preferably at least 2, more preferably at least 4, still preferably 4 to 100,000, particularly preferably 10 to 10,000, most preferably 30 to 1,000, further most preferably 100 to 1,000, alcoholic groups per one molecule. The ratio of the number of alcoholic groups to the total number of functional groups per one molecule ($x_1$) is preferably 0.05 or more, still preferably 0.2 to 1.0, particularly preferably 0.4 to 1.0, most preferably 0.6 to 1.0. The term "functional group" as used herein means those residual groups which are more reactive than hydrocarbon residual groups such as a methyl group, including hetero atoms and hetero atom-containing atomic groups. The ratio of the total mass of the alcoholic groups to the total mass of a molecule ($x_2$) is preferably 0.01 to 0.6, still preferably 0.05 to 0.55, particularly preferably 0.1 to 0.5.

Examples of compound $B^0$ are (i) carbohydrates, (ii) polyhydric alcohols, and (iii) polymers represented by formula (II).

The carbohydrates as compound $B^0$ are polysaccharides satisfying the above-specified molecular weight condition, which include homopolysaccharides comprising a single kind of a constituent sugar and heteropolysaccharides comprising two or more kinds of constituent sugars. Examples of the constituent sugars include monosaccharides having a molecular formula of $(CH_2O)_n$ (wherein n is 5 to 7) and derivatives thereof, such as sugar alcohols, aldonic acids having a —COOH group in place of a —CHO group, uronic acids having a —COOH group in place of a $—CH_2OH$ group, and amino sugars. In addition, sugar derivatives, such as viscose, methyl cellulose, ethyl cellulose, hydroxyethyl cellulose, carboxymethyl cellulose, soluble starch, carboxymethyl starch, dialdehyde starch, and glycosides, are also included. Carbohydrates other than nucleic acids are preferred. Carbohydrates other than glycosides are particularly preferred.

Specific examples of the carbohydrates are starch (sweet potato starch, potato starch, tapioca starch, wheat starch or corn starch), konjac (*Amorphophallus Konjac* C. Koch), funori (a glue plant), agar, sodium alginate, hibiscus (*Hibiscus manihot* Linne), tragacanth gum, gum arabic, dextran, dextrin, and levan. Galactose including agar, etc. is preferred.

The polyhydric alcohols (ii), which are also called alkane polyols, include glycerol, glycitol, and ethylene glycol.

In formula (II), D represents a repeating unit derived from an ethylenically unsaturated monomer having at least one alcoholic group; E represents a repeating unit other than repeating unit D, derived from an ethylenically unsaturated monomer; d represents the weight percentage of D, ranging generally 5 to 100, preferably 20 to 100, still preferably 40 to 100; and e represents the weight percentage of E, ranging generally 0 to 95, preferably 0 to 80, still preferably 0 to 60. The ethylenically unsaturated monomer providing E includes the above-mentioned monomers which provide B of formula (I) and the monomers represented by formula (IV).

Of the polymers (iii) having the formula (II), vinyl acetate-vinyl alcohol copolymers are preferred. The copolymerization ratio can be adjusted by the degree of saponification of polyvinyl acetate.

As the other details of the compounds represented by formulae (I) and (II) and methods of polymerization for obtaining these compounds, reference can be made, e.g., to Teiji Tsuruta, *Kobunshi Gōsei Hannō* (revised ed.), The Nikkan Kogyo Shimbun Ltd. (1971), Takayuki Ohtsu, et al., *Kobunshi Gōsei no Jikkenhō*, Kagaku Dojin, pp. 124–154 (1972), JP-A-6-19029, and the references listed below for water-soluble high polymers.

The compounds (i) to (iii) described above may be used as a combination of two or more thereof at an appropriate mixing ratio. They can be added to a reaction system as such, in a powdered form, or in a dissolved state. They may be added as dissolved in acidic, neutral or alkaline water. For the details of the compounds (i) to (iii), reference can be made to Shinji Nagatomo (ed.), *Shin Suiyosei Polymer no Oyo to Shijo* (application and market of water-soluble polymers), C.M.C. (1988), Keiei Kaihatsu Center Shuppan-bu (ed.), *Suiyosei Kobunshi Sui-bunsangata Jushi Sogogijutsu Shiryoshu* (data of water-soluble high polymers and water-dispersed resins), Keiei Kaihatsu Center Shuppan-bu (1981), Tadanori Misawa (ed.), *Suiyosei Kobunshi* (water-soluble high polymers), 3rd ed., Kagaku Kogyosha (1990), and C. A. Finch (ed.), *Polyvinyl Alcohol*, John Wiley & Sons (1992).

[III] Physical Properties of AgX Emulsion:

The terminology "projected area" as used herein means a projected area of AgX grains arranged on a substrate so as not to overlap each other and with the main planes of tabular AgX grains being in parallel with the substrate. The AgX emulsion of the present invention is one comprising at least a dispersing medium and AgX grains, in which tabular grains having a {100} face as a main plane and an aspect ratio (diameter/thickness ratio) of not less than 2.0 (preferably 3 to 25, still preferably 4 to 20) occupy at least 60% of the total projected area.

The term "diameter" as used here for the tabular grains means a circle-equivalent diameter, i.e., a diameter of a circle the area of which is equal to the projected area of a tabular grain under electron microscopic observation. The term "thickness" means the distance between main planes of a tabular grain. The tabular grain preferably has a thickness of not larger than 0.5 $\mu$m, still preferably 0.03 to 0.3 $\mu$m, particularly preferably 0.05 to 0.2 $\mu$m, and a circle-equivalent diameter of not larger than 10 $\mu$m, still preferably 0.2 to 5 $\mu$m. While the halogen composition of the tabular grains is not particularly limited, a $I^-$ content is preferably not more than 20 mol %, more preferably 0 to 10 mol %. The distribution of the tabular grain diameter are preferably monodisperse. A preferred degree of monodispersion is preferably 0 to 0.4, still preferably 0 to 0.3, particularly preferably 0 to 0.2, in terms of coefficient of the grain diameter distribution (standard deviation/mean diameter).

The terminology "main plane" as used herein denotes the largest outer surface of a tabular grain and another large outer surface in parallel thereto. The projected contour of the tabular grains (the shape of the edges of the top view of a tabular grain placed on a substrate with its main planes parallel to the substrate) includes (1) a right-angled parallelogram, (2) a right-angled parallelogram with one or more of the four corners thereof being missing non-equivalently (for the details, refer to JP-A-5-313273 and JP-A-7-146522, (3) a right-angled parallelogram with at least two sides facing to each other are convexly curved, (4) a right-angled parallelogram with the four corners thereof being equivalently missing provided that the ratio of the largest missing area to the smallest one in a grain is less than 2, and (5) a shape having a {n10} face between the main plane and the {100} edge face, wherein n is an integer of generally 1 to 5, preferably 1. In the case of (5), the area ratio of the {n10} faces to the total surface area of a tabular grain is preferably 0.1 to 30%, still preferably 1 to 15%. In the case of (2) and (4), the edge plane(s) on the missing part(s) is/are a {111} face and/or a {n10} face (n is as defined above). The above (1) and (2) are preferred.

The right-angled parallelogram enclosed with the {100} faces at the edges or a right-angled parallelogram formed by extending the {100} faces at the edges has a slenderness side ratio (a ratio of the length of the long side to that of the short side) of generally 1 to 6, preferably 1 to 4, still preferably 1 to 3, particularly preferably 1 to 2. The former right-angled parallelogram corresponds to the projected contour of the tabular grain, and the latter to a right-angled parallelogram circumscribing the {100} face of the tabular grain.

A proportion of grains having the above-defined long side/short side ratio (i.e., a slenderness side ratio) of 7 or more and/or grains composed of two or more of such the grains fused together at right angles or in parallel is preferably not more than 18% by weight, still preferably 0 to 15% by weight, most preferably 0 to 10% by weight, particularly preferably 0 to 2%, based on the total AgX grains.

The tabular grains comprise AgCl, AgBr, AgBrI, AgClI or a mixture thereof, preferably have an $I^-$ content of 0 to 20 mol %, still preferably 0 to 10 mol %, and preferably have an AgCl content of 50 to 100 mol %, still preferably 75 to 99.9 mol %.

With respect to the halogen composition distribution in individual tabular grains, JP-A-6-59360, JP-A-5-313273, JP-A-7-234470, and JP-A-5-27411 can be referred to. For example, the tabular grains can have such grain structures as illustrated in the accompanying drawings of these patent applications, in which the white background portion and the hatched portion differ in $Br^-$ or $Cl^-$ content by generally 1 to 70 mol %, preferably 5 to 50 mol %, or in $I^-$ content by generally 0.3 to 30 mol %, preferably 1 to 20 mol %. The hatched portion has a thickness corresponding to at least 3 atomic layers. It is preferable that the above-specified halogen content or thickness in the hatched portion be distributed substantially uniformly not only in an individual grain but among grains.

Additionally, grains whose surface layer has an $SCN^-$ or $I^-$ content of generally not less than 0.1 mol %, preferably 0.5 to 50 mol %, and grains whose surface layer has a $Br^-$ content of generally 1 to 100 mol %, preferably 5 to 80 mol %, are also included in useful embodiments of halide distribution. The terminology "surface layer" as referred to above denotes the surface portion corresponding to 1 to 1,000 atomic layers (preferably 1 to 3 atomic layers) from the outer surface. It is preferable that the above-specified content or surface layer thickness be distributed substantially uniformly not only in an individual grain but among grains.

The term "substantially uniformly" as used above means that the coefficient of variation of the content (standard deviation/mean content) preferably ranges 0 to 0.4, still preferably 0 to 0.2, particularly preferably 0 to 0.1.

Additionally, the embodiment that the grains are ununiformly distributed on the surface (layer) of grains (e.g., the coefficient of variation=more than 0.4) is exemplified. Particularly, the embodiment that the edge portion and corner portion or the vicinity thereof is upheaved can be exemplified, as described in U.S. Pat. No. 5,275,930.

[IV] Formation of Tabular Grains:

[IV-1] Seed Formation Stage:

The tabular grains owe their tabular form to crystal defects enabling preferential growth in the edge direction. Such the crystal defects are formed at the time of seed formation by, for example, the following four methods (i) to (iv). That is, AgX grains are converted from isotropic growth grains to the tabular grains by the following methods to form the tabular seed crystals.

Method (i):

$Ag^+$ and $X^-$ are added to an aqueous solution containing compound $A^0$ and/or compound $B^0$. The compound $A^0$ and/or compound $B^0$ are adsorbed onto AgX nuclei formed, and a crystal defect is provided when $Ag^+$ and $X^-$ are further built up on the nuclei. In some cases, the compound $A^0$ and/or compound $B^0$ form a complex with added $Ag^+$ or $X^-$, and a crystal defect is provided when the complex is incorporated into the AgX nuclei.

Method (ii):

$AgX_0$ nuclei substantially free from crystal defects are formed in an aqueous solution of a dispersing medium. Compound $A^0$ and/or compound $B^0$ are added thereto and adsorbed onto the $AgX_0$ nuclei. $Ag^+$ and $X^-$ are then added thereto, and a crystal defect is provided when the added $Ag^+$ and $X^-$ are built up on the AgX nuclei. The term "substantially free" as used above means that the amount of defects initially present in $AgX_0$ is preferably 0 to 20%, still preferably 0 to 5%, particularly 0 to 1%, of the total defects formed through the seed formation step.

Compound $A^0$ and/or compound $B^0$ may be added while adding $Ag^+$ and $X^-$, or may be added after completion of addition of $Ag^+$ and $X^-$. Also, after the compound $A^0$ and/or compound $B^0$ are added, $Ag^+$ and $X^-$ may be added at the same temperature, or the compound $A^0$and/or compound $B^0$ are added and then after the temperature is raised to generally 3° C. or more, preferably 5° to 70° C., more preferably 10° to 60° C., $Ag^+$ and $X^-$ may be added. As a result, the defects can be formed by the above addition method. Among the addition methods, it is preferred that after compound $A^0$ and/or compound $B^0$ are added, $Ag^+$ and $X^-$ are added. That is, addition under the best condition selected is preferred.

Method (iii):

At the time of seed formation of AgX, a halogen gap interface is introduced into nuclei to form a crystal lattice strain, from which a defect is formed. For example, $Ag^+$ and $Xa^-$ are added to form AgXa nuclei at first. $Ag^+$ and $Xb^-$ are then added to form (AgXa|AgXb) seed. $AgXa^-$ and $AgXb^-$ differ in $Cl^-$, $Br^-$ or $I^-$ content by generally 10 to 100 mol %, preferably 30 to 100 mol %, still preferably 50 to 100 mol %. $Xa^-$ and $Xb^-$ each indicate the halogen composition of a halide solution added. At least 1, preferably 1 to 5, still preferably 2 to 4, halogen gaps are thus formed. Such (AgXa|AgXb) seed can also be formed by a method comprising once forming AgXa nuclei and adding $Xc^-$ alone or both $Xc^-$ and $Ag_c^+$ at a molar ratio of generally $Xc^->Ag_c^+$, preferably $Xc^->2Ag_c^+$ (i.e., $Xc^-/Ag_c^+$ molar ratio is more than 2), still preferably $Xc^->5Ag_c^+$. This method is preferred to the previous one. It is preferred that the solubility of AgXc be 1/1.5 or less, still preferably 1/3 or less, particularly 1/8 or less, of that of AgXa. According to this method, halogen conversion occurs between added Xc and AgXa to form (Agxa|AgXc) seed.

$X^-$ can be added by a method comprising adding $Cl_2$, $Br_2$, $I_2$ or a mixture thereof and then adding a reducing agent to gene rate $X^-$. The halogen may be added in any form of gas, aqueous solution, solid, and inclusion compound. The halogen may also be fed in the form of $[X_2+X^-\rightarrow(X_3)^-]$, e.g., in the form of an aqueous solution of $(I_3)^-$. The reducing agent is selected from those capable of providing a negative standard electrode potential with reference to the standard electrode potential of $[X_2+2\text{ electrons}\Leftrightarrow 2X^-]$. Photographically inert reducing agents are preferred, with $H_2SO_3$ being still preferred. The reducing agent may be added as a mixed aqueous solution with the aforesaid carbohydrate.

$X^-$ may also be added by a method of adding a $Br^-$— or $I^-$— releasing agent to a reaction system to let the agent release $Br^-$ or $I^-$. For the details, refer to JP-A-6-19029, EP 0561415A, and U.S. Pat. No. 5,061,615.

The halogen gap can also be introduced by a method comprising first forming AgXa nuclei and then adding fine AgXb particles, followed by ripening to form (AgXa|AgXb), wherein Xa and Xb are as defined above. The fine AgXb particles have a diameter of generally not greater than 0.15 μm, preferably 0.003 to 0.07 μm, still preferably 0.005 to 0.05 μm.

Method (iv):

A defect can be formed by previously adding $I^-$ to an aqueous solution of a dispersing medium prior to nucleation and/or adding $X^-$, which is to be added for nucleation together with $Ag^+$, in the form of a solution containing both $I^-$ and $Cl^-$. In the former method, $I^-$ is added to a concentration of generally $1\times10^{-5}$ to $1\times10^{-1}$ mol/l, preferably $1\times10^{-4}$ to $1\times10^{-2}$ mol/l. In the latter method, the $I^-$ content is preferably not more than 30 mol %, still preferably from 0.1 to 10 mol %, and the $Cl^-$ content is preferably not less than 30 mol %, still preferably not less than 50 mol %.

In any of methods (i) to (iv), the amount of defects to be formed is preferably decided from the shape of finally obtained AgX grains so as to give the best results. If the amount of the defects formed is too small, the proportion of tabular grains in number in the total AgX grains will be insufficient. If it is too large, too many defects introduced per one grain result in increase of the proportion of the number of grains having low aspect ratios. Accordingly, it is desirable to select such an amount of defects at which the projected area ratio of tabular grains falls within a preferred ratio. In the case of method (i) or (ii) is followed, the amount of defects formed increases as the amount of compound $A^0$ and/or compound $B^0$ is increased, as the concentration of gelatin as dispersing medium is decreased, or as the adsorption force (the force of holding to the grains) of the compound(s) is increased. In the case of method (iii) is followed, the amount of defects formed increases as the gap of halide composition is increased, as the amount of conversion is increased, or as the amount of AgXa or AgXb is increased. In the case of method (iv), the amount of defects formed increases as the amount of $I^-$ is increased.

The amount of defects formed also depends on the pH or $X^-$ concentration of the reaction system. A preferred pH value and a preferred $X^-$ concentration can be selected accordingly. Where method (iii) is adopted, halogen conversion takes place preferentially at the edges and corners of AgXa nuclei, where defects are preferentially formed.

Among methods (i), (ii), (iii) and (iv), methods (i), (ii) and (iii) are preferred, further methods (i) and (ii) are more preferred and method (ii) is most preferred.

Since method (ii) is effectively acted in a low pH condition (i.e., pH=1 to 6), it is advantage for decreasing a thickness of grains. In the present invention, the term "nucleus" indicates a fine Ag X grain.

[IV-2] Ripening Growth Stage and Grain Formation Procedure:

Formation of nuclei having crystal defects is followed by ripening. Specifically, the temperature of the reaction system is raised by generally at least 5° C., preferably 10° to 70° C., still preferably 20° to 70° C., to cause Ostwald ripening, that is, to make non-tabular grains disappear and to allow only tabular grains to grow. The ripening may be carried out while adding $Ag^+$ and $X^-$ at low feeding rates. The ripening may also be conducted by increasing the $X^-$ concentration or by adding an AgX solvent to increase the solubility of AgX. The pH of the ripening system is generally 1 to 11, preferably 1.7 to 9. The literature hereinafter described can be referred to as for the AgX solvent. The AgX solvent is used in an amount of 0 to 0.1 mol/l, preferably 0 to 0.001 mol/l. The AgX solvent added may be deactivated after ripening. For example, $NH_3$ added as AgX solvent can be deactivated by conversion to $NH_4^+$, and a thioether compound can be deactivated by oxidation of the thioether group.

Through the ripening, the proportion of tabular grains in number is increased to preferably 1.5 times or more, still preferably 3 to 500 times, particularly 6 to 200 times. After the tabular grains thus increases in number, they go into the stage of growth. The mode of tabular grain formation according to the present invention includes:

(a) seed formation by method (i) or (ii) in [IV—1] (→treatment for weakening the adsorption force of the adsorbable agent → ripening) → growth, provided that at least one step in ( ) may be properly omitted; and (b) seed formation by method (iii) or (iv) in [IV—1] → ripening → growth (an adsorbable agent ($A^0$ and/or $B^0$) which is adsorbed by moderate force is added at a stage from before ripening to 5 minutes before the completion of grain growth, preferably after ripening and before growth).

The treatment for weakening the adsorption force of the adsorbable agent can be carried out as follows. (1) Where the adsorbable agent is compound $A^0$, the pH of the system is lowered to (pKa+0.5) or lower, preferably (pKa+0.2) or lower, still preferably pKa to (pKa−4.0). (2) Where the adsorbable agent is compound $B^0$, the pH and/or $X^-$ concentration of the reaction system are selected so as to lessen the adsorption force. Generally the adsorption force is made weaker as the pH is lowered or as the $X^-$ concentration is increased. The effect is believed to be attributed to change of the alcoholic group to —$OH_2^+$ on pH reduction and reaction between the alcoholic group and a hydrogen halide (R—OH+HX→R—X+$H_2O$). The treatments effective on compound $B^0$ also include (3) addition of an oxidizing agent, such as $H_2O_2$ or $KMnO_4$, to convert the alcoholic group to —CHO or —COOH, (4) esterification of the alcoholic group, (5) dehydration, and (6) reaction with a phosphorus trihalide. For the details of these treatments, refer to R. T. Morrison and R. N. Boyd, *Yuki Kagaku*, 6th ed., Ch. 6, Tokyo Kagaku Dojin (1994), and S. Patai (ed.), *The Chemistry of the Hydroxyl Group*, Interscience Publishers (1971).

The treatments which are effective on both compounds $A^0$and $B^0$ also include (7) addition of a dispersing medium which suppresses defect formation, for example gelatin, in this case, a (gelatin weight/absorbable agent weight) ratio is generally 0.1 or more, preferably 0.3 to 300, more preferably 1 to 100, (8) temperature rise (the adsorption⇆ desorption equilibrium generally shifts to the right hand side on temperature rise (preferably 5° to 60° C., more preferably 10° to 50° C.)), and (9) removal of a part or the whole (preferably 10 to 100%, more preferably 20 to 90%) of the adsorbable agent by, for example, centrifugal separation or ultrafiltration. In treatment (9), the removal of the adsorbable agent is preferably after addition of the compound used in treatment (7), e.g., gelatin. Suitable gelatin species and other dispersing media to be used can be selected from among known photographic dispersing media by referring to the references hereinafter listed. By carrying out these treatments in mode (a), defect formation during grain growth can be avoided substantially. It is also desirable that defect formation be avoided substantially during grain growth according to mode (b). The term "substantially" as used herein means that the amount of defects which may be formed during growth is generally not more than 30%, preferably 0 to 10%, still preferably 0 to 2%, of the defects present before the growth stage. It is desirable for the adsorbable agent to keep its capability of shape control while the grains are growing. According as the adsorbable agent has its force of holding onto grains weakened, it first follows that the capability of defect formation is lost. As the force is further weakened, the capability of shape control is gradually weakened ultimately to the same level as possessed by general gelatin. Accordingly, the adsorbable agent can maintain its capability of shape control even after losing its capability of defect formation by moderately setting the degree of weakening of the adsorption force. The term "capability of shape control" as used herein designates an ability of shifting the above-described relationship of the silver potential vs. shape of AgBr grains in a grain formation system containing gelatin to a lower side of silver potential by 10 mV or more, preferably 20 to 150 mV, more preferably 30 to 120 mV, most preferably 50 to 100 mV.

In mode (2), the adsorbable agent added does not act as defect forming agent but as shape controlling agent. When expressed more directly, the capability of shape control is an ability of controlling a thickness increase during growth to 80% or less, preferably 60% or less, still preferably 30% or less, of that observed in the growth system containing no shape controlling agent with the other conditions except the pH being equal. The pH of both the system containing a shape controlling agent and the system containing no shape controlling agent can be selected from 1 to 11 so as to give the best results, i.e., so that the thickness increase may be inhibited the most). When the $X^-$ concentration is also varied, the $X^-$ concentration for obtaining tabular grains of a given thickness in the system containing a shape controlling agent is generally 1.5 or more times, preferably 2 to 100 times, that in the system containing no shape controlling agent.

Figure 2:
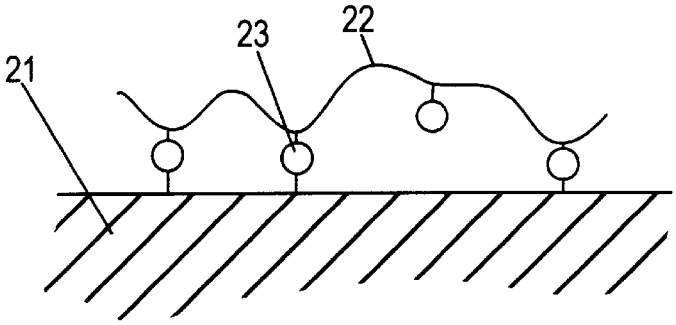
FIG. 2 illustrates an adsorbable agent having a number of weakly adsorbable groups per molecule in the adsorbed state onto the surface of an AgX grain.

Formation of tabular grains in the presence of compound $C^0$ is known from EP 0534395A1. However, compound $A^0$ having two or more molecules of compound $C^0$ covalently bonded to each molecule thereof is superior to compound $C^0$ per se in effect. This seems to be because, taking the adsorption energy of compound $C^0$ adsorbed on the {100} faces of AgX grains as $EC^0$, the adsorption energy of compound $A^0$having bonded thereto n molecules of compound $C^0$ amounts to about n×$EC^0$. That is, however small $EC^0$ may be, it is considered that a desired adsorption force can be obtained almost arbitrarily by selecting the n value. A strong adsorption force can thus be secured at the time of crystal defect formation, while the adsorption force can be lessened at the time of growth by, for example, adjusting the pH to the pKa of compound $A^0$ or lower. If the pH is lowered to (pKa —1.0) or even lower, the adsorption force is substantially lost. Therefore, compound $A^0$ is advantageous in that the adsorption force can be adjusted freely over a broader range to produce more appreciable effects than compound $C^0$.

Where compound $A^0$ is added to the growth system according to mode (2), the compound $A^0$ to be added is designed by selecting compound $C^0$ having weak adsorption force by nature and selecting a large number as n so that no further defect formation may occur, growth inhibition may be minimized, and the shape of growing grains may be under control. These effects can be accounted for as follows. As shown in FIG. 2, since there are many adsorbable sites per one molecule, compound $A^0$ maintains the adsorbed state thereby exhibiting capability of shape control. On the other hand, since the individual adsorbable sites have a weak holding force, adsorption and desorption are repeated frequently at each site. At the time of desorption, $Ag^+$ and $X^-$ are allowed to be built up.

On the other hand, compound $B^0$ can also be designed so as to be adsorbed firmly on AgX grains to form crystal defects and, at the time of grain growth, to control growth characteristics without substantially forming further defects. It has been unknown that the polyhydric alcohol compound has a defect forming action during nucleation and a shape controlling action during growth of tabular grains. Besides, the effects of compound $B^0$ are superior to compound $A^0$'s. The adsorption force of compound $B^0$ increases as the number of alcoholic groups per one molecule increases (and the molecular weight increases accordingly), or as the value $x_1$ increases. Therefore, the adsorption force can be adjusted through adjustment of these values.

In using either adsorbable agent $A^0$ or $B^0$, the adsorption force is reduced as the ratio of non-adsorbable water-soluble functional groups increases. The non-adsorbable water-soluble functional groups help the molecules of the adsorbable agent swim about in the reaction system in a non-adsorbed state. Adsorbable agents $A^0$ and $B^0$ may be used as a mixture thereof at an appropriate mixing ratio.

The mode of adsorption of the polyhydric alcohol compound onto the surface of AgX grains is complicated. While compound $C^0$, added at a pH of its pKa or more, is adsorbed on the $Ag^+$ sites on the surface of AgX grains to reduce the ion conductance ($\sigma_i$) of the AgX grains, adsorption of compound $B^0$ on AgX grains resulted in an increase of $\sigma_i$ of any of cubic AgBr grains, octahedral AgBr grains, and cubic AgCl grains. Such the adsorbable agent is unknown, and acceleration of {100} face formation with an increase in $\sigma_i$ of grains is a new phenomenon. In particular, the $\sigma_i$ of cubic AgBr grains was found to be increased twofold or more. Accordingly, it is considered that compound $B^0$ strongly interacts also with $X^-$ to exhibit powerful shape controlling properties, provided that the $\sigma_i$ is measured by the dielectric loss method.

It is preferable that defect formation substantially completes before the start of grain growth. A preferred amount of the silver salt added before the start of grain growth is not more than a half, particularly not more than a quarter, of the total silver salt added throughout the grain formation step.

In formation period and growth period of crystal seeds, combination use of the adsorbable agent and gelatin is more preferred as compared with single use of the adsorbable agent.

The well-known gelatin can be used in an amount of preferably 0.05 to 10 wt. % and more preferably 0.2 to 5 wt %.

The ratio (i.e., weight ratio of adsorbable agent/gelatin) is preferably 0.01 to 0.9, more preferably 0.03 to 0.5 and most preferably 0.06 to 0.3.

The temperature in the formation period of crystal seeds is generally 10° to 90° C.

The temperature in the crystal defect formation period of methods (i) and (ii) is preferably 30° to 90° C. and more preferably 40° to 85° C.

The ability capable of forming the crystal defect against fine AgCl grains of compound $B^0$ is maximized in the vicinity of pH=4 at a temperature of 50° to 85° C.

[V] Other Particulars:

The terminology "seed formation" indicates a period from the start of AgX nucleation to the start of temperature rise; the terminology "ripening period" indicates a period from the start of temperature rise to the start of growth; and the terminology "growth period" indicates a period of from the start to the end of growth. The optimum pH and $X^-$ concentration during the seed formation period, ripening period and growth period are selected from a pH of 1 to 11, preferably 1.7 to 9, and an $X^-$ concentration of not more than $1\times10^{-0.9}$ mol/l, preferably $1\times10^{-4}$ to $1\times10^{-1.2}$ mol/l.

For the details of oxidizing agents and reducing agents which can be used in the present invention, reference can be made to *Kagaku Jiten*, Tokyo Kagaku Dojin (1994), JP-A7-311428, Nippon Kagakukai (ed.), *Shin-Jikken Kagaku Koza*, Vol. 15, "Sanka to Kangen", Maruzen (1976), Minoru Imoto (ed.), *Koza Yuki Han-no Kiko*, Vol. 10, Tokyo Kagaku Dojin (1965), Yoshiro Ogata (ed.), *Yuki Kagobutsu no Sanka to Kangen*, Nankodo (1963), and item "Sankazai and Kangenzai", JP-A-61-3134, and *Kagaku Taijiten*, Kyoritsu Shuppan (1963).

Figure 3A:
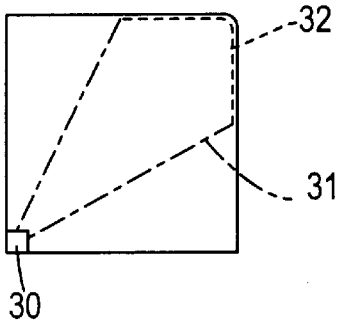
FIGS. 3-(*a*), (*b*) and (*c*) each show an embodiment of lines and a plane defect.
Figure 3B:
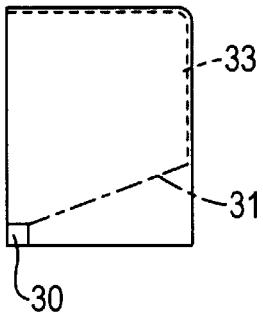
Figure 3C:
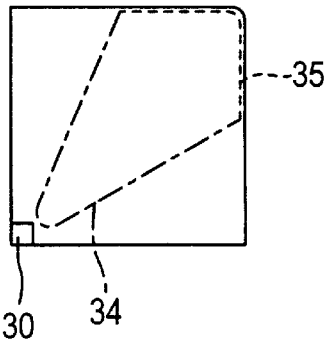

The characteristics of the defects are explained below. Most of the defects are considered to be plane defects in the planes parallel to the main planes as can be seen from direct observation of tabular grains under a transmission electron microscope (hereinafter abbreviated as TEM) at −100° C. or lower, which reveals lines recognized as dislocation lines and a step at the edge surface in agreement with the dislocation lines. In FIG. 3 are illustrated typical examples of such plane defects. In FIG. 3-(*a*), the edge surface between two dislocation lines has step line 32 and exhibits a growth accelerating action. In FIG. 3-(*b*), step line 33 has a growth accelerating action. Where grains are allowed to grow in high temperatures, such dislocation lines are observed to move little by little in the grain as shown in FIG. 3-(*c*). In the present invention, it is preferable that tabular grains having two dislocation lines extending from the corner on the surface corresponding to seed at an acute angle occupy generally 20% or more, preferably 30 to 100%, still preferably 40 to 80%, of the projected area of the total tabular grains. The seed corresponds those formed during seed formation.

Where such the plane defect is formed by forming a (AgCl|AgI|AgCl gap seed or by $I^-$ conversion of AgCl nuclei according to method (iii) described in [IV-1] above, step line 33 tends to become long.

After formation of tabular grains, it is possible to cover the entire surface of the grains with an AgX layer of different halogen composition to a thickness of a single atomic layer or more, preferably 5 to 1000 atomic layers. It is also possible to cause halogen conversion on the grain surface by addition of a thiocyanate or halide solution. The amount of thiocyanate or halide to be added is 0.1 to 1000 mol per mole of the surfacing halogen atoms of all the grains. The halide to be added includes $I^-$, $Br^-$ or a mixed halide of two or more of $I^-$, $Br^-$, and $Cl^-$ (the mixing ratio is arbitrary).

As dispersing medium used during grain formation, gelatin having a methionine content of 0 to 40 $\mu$mol/g or modified gelatin (e.g., phthalated gelatin) described in Japanese Patent Application No. 184128/94 is advantageous. It is used in a proportion of generally 20 to 100%, preferably 50 to 100%, still preferably 80 to 100%, by weight based on the total dispersing medium.

Additionally, it is preferred that the proceeding that the ability of dispersing medium for forming complex with $Ag^+$ from after $AgX_0$ nucleus formation to before 5 minutes of the growth completion is decreased to 1 to 90% of the original ability, is carried out. Particularly, it is preferred that the proceeding that the complex-forming ability of 1.0 wt % aqueous solution of dispersing medium having a pH of 2 to 4 is described to 3 to 70% of the original ability. For concrete example, it is preferred that an oxidizing agent is added, and particularly $H_2O_2$ is added. Such the addition of the oxidizing agent is described in JP-A-7-311428.

In the present invention, the tabular grains are prepared in the presence of compound $A^0$ and/or compound $B^0$, and the (presence) concentration which is present in the AgX emulsion is a concentration so that the equilibrium crystal potential habit-shifted amount is generally 10 mV or more, preferably 20 to 150 mV, more preferably 30 to 120 mV and most preferably 50 to 100 mV.

In defect formation method (ii) described in [IV-1] above, the $AgX^0$ nuclei are substantially free from defects, which can be confirmed as follows. $Ag^+$ and $X^-$ are added to the $AgX^0$ nuclei at a low temperature (25° to 40° C.) at such feeding rates that do not cause Ostwald ripening nor generation of new nuclei to allow all the nuclei to grow to a diameter of about 0.3 $\mu$m in the absence of an AgX solvent. A TEM image of the replica of the grains thus formed is observed to obtain the proportion of the tabular grains. Tabular grains with an increased aspect ratio would be obtained by using the above-described gelatin species and allowing the nuclei under a lower degree of supersaturation.

The resulting grains may be used as host grains which are to epitaxially grow. Further, the resulting grains may be used as core to provide grains having dislocation lines in the inside thereof. Furthermore, the resulting grains may be used as substrate on which an AgX layer of different halogen composition may be laminated. With respect to these techniques, the following list of references can be referred to.

The tabular grains may also be used as core to provide a shallow internal latent image type emulsion or core/shell type grains. Reference can be made to JP-A-59-133542, JP-A-63-151618, U.S. Pat. Nos. 3,206,313, 3,317,322, 3,761,276, 4,269,927, and 3,367,778.

A mixture of the AgX emulsion of the present invention and one or more of other AgX emulsions or a mixture of two or more AgX emulsions of the present invention differing in grain size may be used. The mixing molar ratio of host AgX to total mixed AgX is preferably selected from the range 0.99 to 0.01 so as to give the best results. The additives which can be used from grain formation through coating are not particularly limited in kind and amount, and any known photographically useful additives may be used in their optimum amounts. Examples of useful additives are AgX solvents, dopants to AgX (e.g., the group VIII noble metal compounds and other metal compounds, chalcogen compounds, and SCN compounds), dispersing media, antifoggants, sensitizing dyes (blue, green, red, infrared, panchromatic or orthochromatic sensitizers), supersensitizers, chemical sensitizers (e.g., sulfur, selenium, tellurium, gold or the group VIII noble metal compounds, phosphorus compounds, thiocyanates, and reduction sensitizers, used either alone or as combination of two or more thereof), fogging agents, emulsion precipitants, surface active agents, hardening agents, dyes, colored image forming agents, additives for color photography, soluble silver salts, latent image stabilizers, developing agents (e.g., hydroquinone compounds), pressure-induced desensitization preventives, matting agents, antistatic agents, and dimensional stabilizers.

The AgX emulsion prepared by the process of the present invention is applicable to any kind of well-known photographic materials, such as black-and-white silver halide light-sensitive materials, e.g., X-ray films, printing films, photographic paper, negative films, microfilms, direct positive light-sensitive materials, and ultrafine-grain dry plates (e.g., photomasks for LSI, shadow masks, masks for liquid crystals); color light-sensitive materials, e.g., negative films, color photographic paper, reversal films, direct positive color light-sensitive materials, and light-sensitive materials for silver dye bleaching process; diffusion transfer light-sensitive materials, e.g., color diffusion transfer elements and silver salt diffusion transfer elements; heat-developable black-and-white or color light-sensitive materials; high-density digital recording materials, and holographic light-sensitive materials. The amount of silver coated is 0.01 $g/m^2$ or more.

Methods for preparing AgX emulsions (grain formation, desalting, chemical sensitization, spectral sensitization, addition of photographic additives, and the like) and equipment therefor, structures of AgX grains, supports, subbing layers, surface protective layers, the constitution of the photographic materials (e.g., layer structure, silver/color former molar ratio, and silver ratio among multiple layers), product forms, methods for storing products, emulsification and dispersion of photographic additives, exposure, development, and the like are not limited, and all the techniques and embodiments that have been or will be known can be used. For the detailed information, refer to *Research Disclosure*, Vol. 176 (Item 17643) (Dec., 1978), ibid, Vol. 307 (Item 307105, Nov., 1989), Duffin, *Photographic Emulsion Chemistry*, Focal Press, New York (1966), E. J. Birr, *Stabilization of Photographic Silver Halide Emulsion*, Focal Press, London (1974), T. H. James, *The Theory of Photographic Process*, 4th Ed., Macmillan, New York (1977), P. Glafkides, *Chimie et Physique Photographic*, 5th Ed., Edition del, Usine Nouvelle, Paris (1987), ibid, 2nd Ed., Poul Montel, Paris (1957), V. L. Zelikman et al., *Making and Coating Photographic Emulsion*, Focal Press (1964), K. R. Hollister, *Journal of Imaging Science*, Vol. 31, pp. 148–156 (1987), J. E. Maskasky, ibid, Vol. 30, pp. 247–254 (1986), ibid, Vol. 32, pp. 160–177 (1988), and ibid, Vol. 33, pp. 10–13 (1989), H. Frieser, et al. (ed.), *Die Grundlagen Der Photogrphischen Prozesse Mit Silverhalogeniden*, Akademische Verlaggesellschaft, Frankfurt (1968), *Nikkakyo Geppo*, issue of Dec., 1984, pp. 18–27, *Nihon Shashin Gakkaishi*, Vol. 49, pp. 7–12 (1986), ibid, Vol. 52, pp. 144–166 (1989), ibid, Vol. 52, pp. 41–48 (1989), JP-A-58-113926, JP-A-58-113927, JP-A-58-113928, JP-A-59-90841, JP-A-58-111936, JP-A-62-99751, JP-A-60-143331, JP-A-60-143332, JP-A-61-14630, JP-A-62-6251, JP-A-1-131541, JP-A-2-838, JP-A-2-146033, JP-A-3-155539, JP-A-3-200952, JP-A-3-246534, JP-A-4-34544, JP-A-2-28638, JP-A-4-109240, JP-A-2-73346, JP-A-4-193336, Japanese Patent Application No. 215513/94, and other Japanese, U.S., European and world patents relating to the AgX photographic field, *Journal of Imaging Science, Journal of Photographic Science, Photographic Science and Engineering, Nihon Shashin Gakkaishi*, the abstracts of lectures at Nihon Shashin Gakkai, International Congress of Photographic Science, and The International East-West Symposium on the Factors Influencing Photographic Sensitivity, and Japanese Patent Application No. 6-104065 and JP-A-7-181620.

The emulsion of the present invention is preferably used as constituent emulsion of coated samples described in Examples of JP-A-62-269958, JP-A-62-266538, JP-A-63-220238, JP-A-63-305343, JP-A-59-142539, JP-A-62-253159, JP-A-1-131541, JP-A-1-297649, JP-A-2-42, JP-A-1-158429, JP-A-3-226730, JP-A-4-151649, JP-A-6-27590, and EP 0508398A1.

Preferred embodiments of the present invention are as follows.

(1) A method for preparing an AgX emulsion, in which the crystal defect is formed by addition of $Ag^+$ and $X^-$ while compound $A^0$or compound $B^0$ is adsorbed on AgX grains.

(2) A method for preparing an AgX emulsion, in which the crystal defect is not substantially formed in the stage of tabular grain growth.

(3) A method for preparing an AgX emulsion, in which the crystal defect is formed by introducing at least one halogen composition gap interface during nucleation, the halogen composition gap interface making a difference of a $Cl^-$, $Br^-$ or $I^-$ content by 10 mol % or more.

(4) A method for preparing an AgX emulsion, in which the crystal defect is formed by first forming $AgX_0$ nuclei which are substantially free from the crystal defect, adding compound $A^0$ and/or compound $B^0$ to be adsorbed on the nuclei, and adding $Ag^+$ and $X^-$ to be built up on-the nuclei.

(5) A method for preparing an AgX emulsion, in which compound $A^0$ is a polymer comprising one or more ethylenically unsaturated monomers and containing at least two molecules of an imidazole group or a benzimidazole group per molecule thereof.

(6) A method for preparing an AgX emulsion, in which compound $B^0$ is polyvinyl alcohol having a molecular weight of 300 or more and $x_1$ value (numbers of alcohol group/total numbers of function group) of 0.2 to 1.0.

(7) A method for preparing an AgX emulsion, in which the (presence) concentration which is present in the AgX emulsion of compound $A^0$ and/or compound $B^0$ is a concentration so that an equilibrium crystal habit-shifted potential amount is 10 mV or more.

The present invention will now be illustrated in greater detail with reference to Examples, but it should be understood that the present invention is not limited thereto. Unless otherwise indicated, all the percents are by weight.

EXAMPLE 1

In this Example is shown an embodiment in which crystal defects are introduced by method (iii), and the nuclei are allowed to grow in the presence of compound $B^0$ under high $X^-$ and low pH conditions to obtain tabular grains having a high AgCl content.

In a reaction vessel was put gelatin-aqueous solution-1 (25 g of gelatin and 1.0 g of NaCl in 1200 ml of water; pH=4.2) and kept at 40° C. Ag-1 solution (200 g of $AgNO_3$/l) and X-1 solution (70 g of NaCl/l) were simultaneously added thereto while stirring both at a rate of 60 ml/min for 15 seconds. Two minutes later, X-2 solution (14.4 g of KBr/l) was added thereto at a rate of 60 ml/min for 20 seconds. Two minutes later, 55 ml of Ag-1 solution and 55 ml of X-1 solution were added simultaneously both at a rate of 60 ml/min. Two minutes later, 23 ml of X-1 solution was added, and a 1N sodium hydroxide-aqueous solution was added to adjust to a pH of 5.2. The emulsion was heated up to 75° C. over 12 minutes, at which it was ripened for 20 minutes. A 1N $HNO_3$ aqueous solution and a polyvinyl alcohol aqueous solution (5 g of polyvinyl alcohol obtained by saponifying polyvinyl acetate having a degree of polymerization of 500 at an average degree of saponification of 98% (hereinafter referred to as PVA-1) in 0.1 l of water) were added, and the reaction solution was adjusted to pH 3.8. The silver potential was about 100 mV with reference to a saturated calomel electrode at room temperature. Ag-1 Solution and X-1 solution were then added thereto according to a double jet process while maintaining at a silver potential of 100 mV, the feeding rate of Ag-1 solution being increased from an initial rate of 7 ml/min at a linear acceleration of 0.05 ml/min over a 35-minute period.

Two minutes later, Ag-1 solution and X-3 solution (7 g of NaCl and 2.1 g of KBr per 100 ml) were simultaneously added both at a rate of 6 ml/min for 5 minutes. A precipitant was added, the temperature was lowered to 30° C., and the pH was adjusted to 4.0 to precipitate the emulsion. The precipitated emulsion was washed with water, and a gelatin aqueous solution was added thereto at 38° C. to redisperse the emulsion. The emulsion was adjusted to a pH of 6.2 and a pCl of 2.8. A part of the resulting emulsion was sampled, and the TEM image of the replica of the emulsion grains was observed. It was found that 94% of the total AgX projected area (hereinafter abbreviated as TPA) comprised tabular grains having a {100} face as a main plane whose projected contour was a right-angled parallelogram and having an aspect ratio of 3 or more. The tabular grains had an average diameter of 1.3 μm, an average aspect ratio of 7.6, an average long side to short side ratio (i.e., a slenderness side ratio) of 1.3, and a coefficient of variation of diameter distribution (standard deviation/mean diameter) (hereinafter abbreviated as C.V.) of 0.17.

EXAMPLE 2

In Example 2 is shown an embodiment in which compound $B^0$ is adsorbed on defect-free AgCl nuclei, and $Ag^+$ and $Cl^-$ are then built up thereon to form defects, and gelatin is added thereto to weaken the adsorption force, followed by temperature rise, ripening, and growth.

In reaction vessel 21 was put gelatin-aqueous solution-2 (25 g of gelatin and 0.3 g of NaCl in 1.2 l of water; pH=3.0) and kept at 30° C. Ag-21 Solution (200 g of $AgNO_3$, 8 g of gelatin, and 2.0 ml of 1N $HNO_3$ in 1 l of water) and X-21 solution (70 g of NaCl and 8 g of gelatin in 1 l of water) were simultaneously added thereto while stirring each at a rate of 120 ml/min for 1 minute. Three minutes later, a 240 ml portion of the emulsion was taken out and put to reaction vessel 22, in which 960 ml of water, 0.3 g of NaCl, and 15 g of PVA-1 had previously been charged (pH=3.0) and kept at 40° C. Ag-1 Solution and X-1 solution were added thereto while stirring each at a rate of 25 ml/min for 10 minutes. Gelatin aqueous solution-21 (20 g of gelatin in 120 ml of water) and X-1 solution were then added thereto, and the emulsion was adjusted to a pH of 3.8 and a silver potential of 100 mV and heated up to 75° C. over 12 minutes. After ripening at that temperature for 12 minutes, Ag-1 solution and X-1 solution were added thereto with the initial feeding rate of 10 ml/min of Ag-1 solution and a linear acceleration of 0.07 ml/min over a period of 35 minutes according to a double jet process while maintaining the silver potential at 100 mV. After 2 minutes, Ag-1 solution and X-3 solution were added simultaneously each at a rate of 7 ml/min over a period of 5 minutes. The resulting emulsion was treated with a precipitant and further worked-up in the same manner as in Example 1.

A part of the obtained emulsion was sampled, and a TEM image of the replica of the emulsion grains was prepared. Observation of the TEM image revealed that 95% of TPA was occupied by tabular grains having a {100} face as a main plane, a right-angled parallelogram as projected contour, and an aspect ratio of 3 or more, and the tabular grains had an average diameter of about 1.3 μm, an average aspect ratio of 7.0, an average long side/short side ratio (i.e., a slenderness side ratio) of 1.5, and a C.V. of 0.16.

EXAMPLE 3

In Example 3 is shown an embodiment in which crystal defects are introduced by method (iii), and the nuclei are allowed to grow in the presence of compound $A^0$ to obtain tabular grains having a high AgCl content.

To a reaction vessel was put gelatin aqueous solution-1, and Ag-1 solution and X-1 solution were simultaneously added thereto while keeping at 35° C. each at a rate of 60 ml/min over a 25-second period. After 2 minutes, X-2 solution was added at a rate of 60 ml/min for 27 seconds. The emulsion was heated to 40° C., at which the emulsion was kept for 5 minutes. Ag-1 Solution (60 ml) and X-1 solution (60 ml) were added thereto simultaneously both at a rate of 60 ml/min. Two minutes later, 23 ml of X-1 solution was added, and an aqueous solution of 10 g of polyvinylimidazole copolymer 1 (acrylamide:acrylic acid:N-vinylimidazole average copolymerization ratio=50:9:10 by the number of molecules, weight average molecular weight= $1.5\times10^5$) and 100 ml of water was added, and the emulsion was adjusted to pH 5.5. The emulsion was heated up to 75° C. over 12 minutes, at which it was ripened for 20 minutes. Ag-1 Solution was added to raise the silver potential to 120 mV, and Ag-1 solution and X-1 solution were added thereto for 35 minutes while keeping the silver potential at that level with the initial feeding rate of Ag-1 solution of 7 ml/min and a linear acceleration of 0.05 ml/min according to a double jet process.

Two minutes later, Ag-1 solution and X-3 solution were added thereto simultaneously each at a rate of 6 ml/min for 5 minutes. The resulting emulsion was treated with a precipitant and further worked-up in the same manner as in Example 1.

A part of the obtained emulsion was sampled, and a TEM image of the replica of the emulsion grains was prepared. Observation of the TEM image revealed that 93% of TPA was occupied by tabular grains having a {100} face as a main plane, a right-angled parallelogram as a projected contour, and an aspect ratio of 3 or more, and the tabular grains had an average diameter of about 1.33 μm, an average aspect ratio of 7.4, an average long side/short side ratio (i.e., a slenderness side ratio) of 1.6, and a C.V. of 0.17.

COMPARATIVE EXAMPLE 1

An AgX emulsion was obtained in the same manner as in Example 1, except for adding water in place of the polyvinyl alcohol-aqueous solution.

As a result of TEM observation, tabular grains having an aspect ratio of 3 or more were not found, and the emulsion grains had an average aspect ratio of 2.0, an average diameter of about 0.83 μm, and a C.V. of 0.15.

COMPARATIVE EXAMPLE 2

Tabular grains were prepared in the presence of 3-amino-1H-1,2,4-triazole in accordance with the procedures described in Example 11B of EP 0534395A1. TEM observation of the emulsion grains revealed that 65% of the TPA was occupied by tabular grains having a {100} face as a main plane, an average diameter of 1.28 μm, and an average aspect ratio of 9.8. Addition of a precipitant and the following working up procedures were the same as in Example 1.

Each of the emulsions obtained in Examples 1 to 3 and Comparative Examples 1 and 2 was subjected to sensitization as follows. The emulsion was heated to 55° C., and 50 ml of Br-1 solution (20 g of NaBr/l) was added thereto while stirring. Five minutes later, sensitizing dye 1 was added in an amount corresponding to 67% of the saturated adsorption. Then, $2.5\times10^{-5}$ mol/mol-AgX of Hypo was added, and $1\times10^{-5}$ mol/mol-Ag of chloroauric acid was added. After ripening, $2\times10^{-3}$ mol/mol-AgX of antifoggant 1 was added, and the emulsion was heated to 40° C.

The coated sample was exposed to light for $10^{-2}$ second through a minus blue filter transmitting light of 520 nm or longer wavelengths and developed with MAA-1 developer (see *Journal of Photographic Science*, Vol. 23, pp. 249–256 (1975)) with its KBr replaced with the same molar concentration of NaCl, at 20° C. for 4 minutes. After passing through a stopping solution, a fixing bath, and a washing bath, the sample was dried. As a result of evaluation of photographic properties, the descending order of sensitivity/graininess was Example 2 (112) >Example 1 (107) >Example 3 (100) >Comparative Example 2 (70) >Comparative Example 1 (50), and the fog density was 0.10 in Example 1, 0.10 in Example 2, 0.15 in Example 3, 0.12 in Comparative Example 1 and 0.18 in Comparative Example 2, thus proving the superiority of the present invention.

EXAMPLE 4

Example 4 is to show an embodiment in which crystal defects are introduced by method (iii), and the grains are allowed to grow in the presence of compound $B^0$ under a high $X^-$ concentration condition to obtain tabular grains having a high AgBr content.

In a reaction vessel was put gelatin-aqueous solution-4 (25 g of gelatin and 0.11 g of NaCl in 1.2 l of water; adjusted to pH 3.9 with an aqueous solution of $HNO_3$), and 8.0 ml of $AgNO_3$-1 solution (10 g of $AgNO_3$/l) was added thereto over 2 seconds with stirring while keeping at 40° C. Five minutes later, X-41 solution (140 g of KBr/l) and Ag-41 solution (200 g of $AgNO_3$/l) were added almost simultaneously each at a rate of 50 ml/min for 1 minute. The start of addition of X-41 solution preceded the start of addition of Ag-41 solution by 1 second. One minute after completion of the addition, the emulsion was adjusted to pH 5.5 by addition of an aqueous solution of NaOH. An aqueous solution of 5 g of PVA-1 in 50 ml of water was added thereto, the silver potential was set at 50 mV, and the temperature was raised up to 75° C. After the temperature rise, the silver potential was again adjusted to 50 mV. After ripening for 30 minutes, Ag-42 solution (100 g of $AgNO_3$/l) and X-42 solution (71 g of KBr/l) were added thereto while maintaining the silver potential at 50 mV with the initial feeding rate of Ag-42 solution of 5 ml/min and a linear acceleration of 0.05 ml/min for 30 minutes. Three minutes later, a precipitant was added, Sensitizing Dye 1:

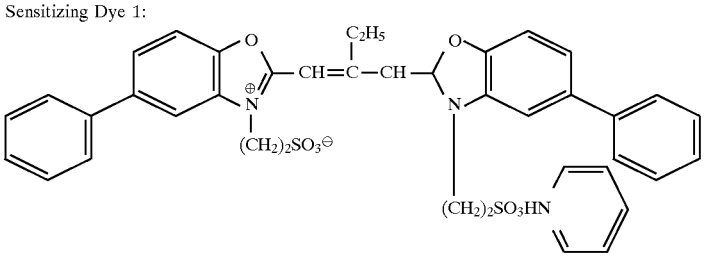

Antifoggant 1:

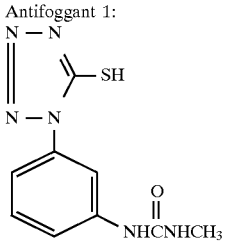

A thickener and a coating aid were added to the emulsion, and the resulting coating composition was applied to a triacetyl cellulose (TAC) film support together with a protective layer and then dried to prepare a coated sample.

the temperature was lowered to 30° C., and the pH was adjusted to 4.0 to precipitate the emulsion. The precipitated emulsion was washed with water, again heated to 38° C., and re-dispersed in an aqueous solution of gelatin. TEM observation of the emulsion grains revealed that 92% of the TPA was occupied by tabular grains whose a main plane was a {100} face and whose projected contour was a right-angled parallelogram with 1 or 2 corners among 4 corners broken off. The average edge length missing was about 10%. The edge surface at the missing corner(s) was a {110} face. The tabular grains had an average diameter of 1.4 μm, an average aspect ratio of 6.0, and a C.V. of 0.21.

COMPARATIVE EXAMPLE 3

An AgX emulsion was prepared in the same manner as in Example 4, except that the polyvinyl alcohol-aqueous solution was not added. As a result of TEM observation, tabular grains having an aspect ratio of 3 or more were not found, and the emulsion grains had an average aspect ratio of 1.8, an average diameter of 0.93 μm, and a C.V. of 0.25.

Each of the emulsions obtained in Example 4 and Comparative Example 3 was subjected to sensitization as follows. The emulsion was heated to 55° C., and sensitizing dye 2 was added in an amount corresponding to 68% of the saturated adsorption. Then, a solution of $1\times10^{-5}$ mol/mol-AgX of a gold-thiocyanate complex (chloroauric acid:NaSCN=1:40 by mole) was added, and $2.5\times10^{-5}$ mol/mol-AgX of Hypo was added. After ripening for 20 minutes, $3\times10^{-3}$ mol/mol-AgX of antifoggant 2 (4-hydroxy-6-methyl-1,3,3*a*,7-tetraazaindene) was added, and the emulsion was heated to 40° C.

Sensitizing Dye 2:

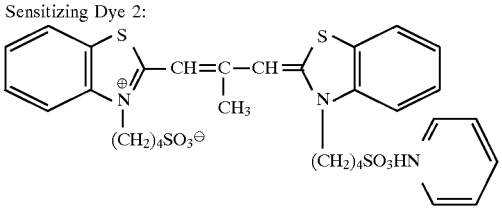

A coated sample was prepared using the sensitized emulsion in the same manner as in Examples 1 to 3. The coated sample was exposed to light for $10^{-2}$ second through a minus blue filter transmitting light of 520 nm or longer wavelengths and developed. After passing through a stopping solution, a fixing bath, and a washing bath, the sample was dried. As a result of evaluation of photographic properties, the descending order of sensitivity/graininess was Example 4 (100) >Comparative Example 3 (51), and, the fog density was 0.16 in Example 4 and 0.16 in Comparative Example 3proving the superiority of the present invention.

EXAMPLE 5

In a reaction vessel was put gelatin-aqueous solution-1 and kept at 30° C., Ag-21 solution and X-21 solution were simultaneously added thereto while stirring both at a rate of 36 ml/min for 3 minutes. One minute later, PV-1 solution (5 g of PV-1 in 50 ml of water) was added thereto. The emulsion was heated up to 75° C. over 15 minutes and after ripened for 10 minutes, a pH and silver potential were adjusted to 3.5 and 100 mV, respectively. Further, Ag-1 solution and X-1 solution were simultaneously added thereto for 15 minutes while maintaining a silver potential of 100 mV. The initial rate of Ag-1 solution was 10 ml/min and the linear acceleration was 0.1 ml/min.

Two minutes later, Ag-1 solution and X-3 solution were simultaneously added both at a rate of 14 ml/min for 1 minute. The resulting emulsion was treated with the precipitant and further worked up in the same manner as in Example 1 of the present invention.

A part of the obtained emulsion was sampled, and a TEM image of the replica of the emulsion grains was prepared. Observation of the TEM image revealed that 95% of TPA was occupied by tabular grains having a {100} face as a main plane and an aspect ratio of 3 or more, and the tabular grains had an average diameter of about 0.55 μm, an average aspect ratio of 7.5 and an average long side/short side ratio (i.e., a slenderness side ratio) of 1.4 and a C.V. of 0.14.

EXAMPLE 6

In a reaction vessel were put gelatin-aqueous solution-1 and PV-1 solution and adjusted to pH 3.5 and then kept at 70° C. Ag-21 solution and X-21 solution were simultaneously added thereto for 25 minutes while stirring and maintaining at a silver potential of 100 mV. The initial rate of Ag-21 solution and X-21 solution was 12 ml/min. Next, further after adjusted to pH 3.0, Ag-21 solution and X-21 solution were simultaneously added under the same condition for 15 minutes. After ripened for 15 minutes, Ag-1 solution and X-3 solution were simultaneously added at 16 ml/min for 1 minute.

The resulting emulsion was treated with the precipitant and further worked up in the same manner as in Example 1 of the present specification.

A part of the obtained emulsion was sampled, and a TEM image of the replica of the emulsion grain was prepared. Observation of the TEM image revealed that 96% of TPA was occupied by tabular grains having a {100} face as a main plane and an aspect ratio of 3 or more, and the tabular grains had an average diameter of about 0.55 μm, an average aspect ratio of 6 and an average long side/short side ratio (i.g., a slenderness side ratio) of 1.7 and a C.V. of 0.19.

EXAMPLE 7

In a reaction vessel was put gelatin-aqueous solution-7 (25 g of gelatin, 0.3 g of KBr in 1.2 liter of $H_2O$) and kept at 32° C., Ag-41 solution and X-41 solution were simultaneously added thereto at 30 ml/min for 5 minutes. Next, polyvinylimidazole copolymer 2 represented by the following formula was added and the obtained emulsion was adjusted to pH 9.0 with 1N-NaOH solution.

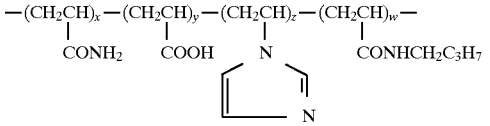

Weight average molecular weight : $1.5\times10^5$
x:y:z:w = 60:7:13:30

Next, the emulsion was heated up to 60° C. and adjusted again to pH 9.0 and a silver potential of 25 mV using a KBr solution (containing 0.1 g of KBr/ml).

Ag-41 solution and X-41 solution were simultaneously added thereto for 20 minutes while maintaining a silver potential of 25 mV.

The initial feeding rate of Ag-41 solution was 25 ml/min. After stirring for 3 minutes, a precipitant was added, the temperature was lowered to 30° C., and the pH was adjusted to 4.0 to precipitate the emulsion. The precipitated emulsion was washed with water, again heated to 38° C., and re-dispersed in an aqueous solution of gelatin. The emulsion was adjusted to a pH of 6.4 and a pBr of 2.8.

The TEM image of the replica of the obtained grains was prepared. Observation of the TEM image revealed that 95% of TPA was occupied by tabular grains having a {100} face as a main plane, a right-angled parallelogram as projected contour, an average aspect ratio of 3 or more, an average diameter of 0.55 $\mu$m and an average long side/short ratio (i.e., a slenderness side ratio) of 1.8.

The obtained emulsion was sensitization-processed in the same manner as in Example 4 to prepare a coated sample. The coated sample was exposed to light and developed. As a result of evaluation of photographic properties, the sensitivity/graininess of Example 7 was 90 as compared with 100 of Example 4. On the other hand, the fog density of Example 7 was 0.16 (which was same as Example 4).

Also, the emulsions obtained in Examples 5 and 6 were sensitization-processed in the same manner as in Examples 1 to 3 to prepare coated samples.

The coated samples were exposed to light and developed under the same condition as in Examples 1 to 3. As a result of evaluation of photographic properties, the sensitivity/graininess of Examples 5 and 6 was 116 and 110 as compared with 100 of Example 4, respectively. The fog density of Examples 5 and 6 was 0.10 and 0.10, respectively.

The crystal defects in Examples 5, 6 and 7 were introduced by methods (ii), (i) and (ii), respectively.

Further, coated samples were prepared in the same manner as in JP-A-6-347946, JP-A-7-5614 and JP-A-7-36134 by using each of the AgX emulsions prepared in the foregoing Examples 1 to 4 in the 5th layer of Sample 118 (Example 1 of JP-A-6-347946), the 5th layer of Sample 103 (Example 1 of JP-A-7-5614), and the emulsion layer of Sample 3 (JP-A-7-36134). All the samples exhibited satisfactory photographic properties.

As has been fully described, the AgX emulsion of the present invention applied to a-support and dried provides photographic materials more excellent in sensitivity, image quality and preservability than those using conventional AgX emulsions.

While the invention has been described in detail and with reference to specific embodiments thereof, it will be apparent to one skilled in the art that various changes and modifications can be made therein without departing from the spirit and scope thereof.

What is claimed is:

1. A method for preparing a silver halide emulsion comprising at least a dispersing medium and silver halide grains, wherein at least 60% of the total projected area of silver halide grains is occupied by tabular grains having a crystal defect for anisotropic growth which have a {100} face as a main plane and an aspect ratio (diameter/thickness ratio) of not less than 2.0, and which have a rectangular-shaped projected contour formed by the edges of the {100} face or formed by extending the edges of the {100} face, wherein the rectangular-shaped projected contour has an edge length ratio (a ratio of the length of the long side to that of the short side) of 1 to 6; and said silver halide emulsion is prepared in the presence of a compound $A^0$ and/or a compound $B^0$, wherein the compound $A^0$ represents a polymer, wherein the polymer is an organic compound which is covalently bonded with from 4 to 1,000 molecules of an adsorbable agent $C^0$ which accelerates formation of a {100} face of silver bromide grains as a branched chain of the polymer, and wherein the compound $B^0$ represents an organic compound except gelatin having at least four alcoholic groups per molecule, wherein both the compound $A^0$ and $B^0$ are organic compounds except gelatin and other proteins, wherein said defect is a defect formed when silver ions and halide are further built up on defect-free formed nuclei on which the compound $A^0$ and/or compound $B^0$ are adsorbed.

2. The method for preparing a silver halide emulsion as claimed in claim 1, wherein said crystal defect is formed in a growth stage of said tabular grains in an amount which is at most 30% of the amount of defects present before the growth stage.

3. The method for preparing a silver halide emulsion as claimed in claim 1, wherein the crystal defect is formed by first forming silver halide nuclei which are substantially free from the crystal defect, adding compound $A^0$ and/or compound $B^0$ to be adsorbed on the nuclei, and adding and silver and halide ions to be built up on the nuclei.

4. The method for preparing a silver halide emulsion as claimed in claim 1, wherein the compound $A^0$ is a polymer comprising one or more ethylenically unsaturated monomers wherein said polymer is covalently bonded with at least two molecules of an imidazole group or a benzimidazole group.

5. The method for preparing a silver halide emulsion as claimed in claim 1 wherein the compound $B^0$ is polyvinyl alcohol having a molecular weight of 300 or more.

6. The method for preparing a silver halide emulsion as claimed in claim 1, wherein the concentration which is present in the AgX emulsion of compound $A^0$ and/or compound $B^0$ is a concentration so that an equilibrium crystal habit-shift potential amount is 10 mV or more.

7. The method for preparing a silver halide emulsion as claimed in claim 1, wherein the adsorbable agent is used in combination with gelatin in an adsorbable agent/gelatin weight ratio of from 0.01 to 0.9.

8. The method for preparing a silver halide emulsion as claimed in claim 1, wherein said compound $A^0$ has from 8 to 1,000 imidazole groups or benzimidazole groups per one molecule, and said compound $B^0$ contains from 4 to 100,000 alcoholic groups per one molecule.

9. The method for preparing a silver halide emulsion as claimed in claim 8, wherein said compound $B^0$ contains from 10 to 10,000 alcoholic groups per one molecule.

10. The method for preparing a silver halide emulsion as claimed in claim 1, wherein said compound $A^0$ is a compound prepared by polymerizing a polymerizable ethylenically unsaturated monomer represented by formula (IV):

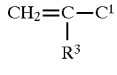

(IV)

wherein $C^1$ represents a residual group of compound $C^0$ bonded to the monomer, and $R^3$ represents a hydrogen atom or an alkyl group having 1 to 10 carbon atoms, or copolymerizing the monomer of formula (IV) with a copolymerizable ethylenically unsaturated monomer represented by formula (V):

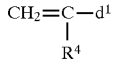

(V)

wherein $d^1$ represents a functional group, and $R^4$ has the same meaning as $R^3$.

11. The method for preparing a silver halide emulsion as claimed in claim 1, wherein said compound $B^0$ is a polymer represented by formula (II):

$$—(D)_d—(E)_e— \quad (II)$$

wherein d and e each represent a weight percentage, provided that d+e=100, D represents a repeating unit obtained from an ethylenically unsaturated monomer having at least one alcoholic group and E represents a repeating unit other than repeating unit D obtained from an ethylenically unsaturated monomer.

* * * * *

UNITED STATES PATENT AND TRADEMARK OFFICE

CERTIFICATE OF CORRECTION

PATENT NO. : 5,807,665
DATED : December 15, 1998
INVENTOR(S) : Mitsuo Saitou

It is certified that error appears in the above-identified patent and that said Letters Patent is hereby corrected as shown below:

Title page,
In item "[22] Filed:", change "April 10, 1996" to -- April 11, 1996 --

Signed and Sealed this

Second Day of October, 2001

*Attest:*

Nicholas P. Godici

NICHOLAS P. GODICI
*Acting Director of the United States Patent and Trademark Office*

*Attesting Officer*